US008920216B2

(12) United States Patent
Panzenhagen et al.

(10) Patent No.: US 8,920,216 B2
(45) Date of Patent: Dec. 30, 2014

(54) CENTERING PLATE FOR CENTRIFUGAL BLASTING WHEEL

(75) Inventors: Carl Panzenhagen, New Berlin, WI (US); Steve Bothe, Waukesha, WI (US)

(73) Assignee: CP Metcast, Inc., New Berlin, WI (US)

( * ) Notice: Subject to any disclaimer, the term of this patent is extended or adjusted under 35 U.S.C. 154(b) by 0 days.

(21) Appl. No.: 13/261,749

(22) PCT Filed: Apr. 2, 2012

(86) PCT No.: PCT/US2012/031871

§ 371 (c)(1), (2), (4) Date: Sep. 27, 2013

(87) PCT Pub. No.: WO2012/135840

PCT Pub. Date: Oct. 4, 2012

(65) Prior Publication Data

US 2014/0087638 A1 Mar. 27, 2014

Related U.S. Application Data

(60) Provisional application No. 61/470,892, filed on Apr. 1, 2011.

(51) Int. Cl.
*B24C 5/06* (2006.01)

(52) U.S. Cl.
CPC .. *B24C 5/06* (2013.01); *B24C 5/062* (2013.01)
USPC ..... 451/97; 451/95

(58) Field of Classification Search
CPC ..... B24C 5/06; B24C 5/062
USPC ..... 451/95, 96, 97, 98
See application file for complete search history.

(56) References Cited

U.S. PATENT DOCUMENTS

| | | | | | |
|---|---|---|---|---|---|
| 2,204,637 | A | * | 6/1940 | Unger | 451/95 |
| 5,209,024 | A | * | 5/1993 | Carpenter et al. | 451/95 |
| 5,476,412 | A | * | 12/1995 | Stoltz | 451/75 |
| 5,888,125 | A | * | 3/1999 | Kuehn | 451/95 |

* cited by examiner

*Primary Examiner* — Robert Rose
(74) *Attorney, Agent, or Firm* — Wozny Law, LLC; Thomas M. Wozny

(57) ABSTRACT

A method and apparatus for inserting blades into a centrifugal blasting wheel to install blades without injury to fingers or hands. The apparatus uses a rotatable blade retainer with a blade guide slot that allows each blade to be installed through the blade guide slot while other installed blades are supported by the outer surface of the rotatable blade retainer. Once all blades are safely installed, the center section of the centering plate is inserted to cover the rotatable blade retainer.

6 Claims, 6 Drawing Sheets

CENTERING PLATE FOR CENTRIFUGAL BLASTING WHEEL

BACKGROUND OF THE INVENTION

The present invention relates to centrifugal abrasive throwing wheels sometimes referred to as blasting wheels or shotblast wheels, used to project particles against work pieces to subject the work to cleaning or abrading action.

In some shotblast wheel designs, blades, numbering between 4 to 12 per wheel, are held in place via mechanical means such as springs, pins, set screws or other mechanical retention devices. In these designs, the operator has minimal difficulty with the blades being held into position while they are being changed as the mechanical spring, pin or set screw holds each blade into position without concern of the blade falling back into the operator's fingers or hand during the blade changing procedure.

Many manufacturers have simplified the designs of centrifugal blast wheels to eliminate costly or difficult to use mechanical blade retention devices that oftentimes can fail or wear quickly. These centrifugal shotblast wheel designs require the operator to physically hold the blades into position with fingers extended into the center of the shot wheel unit. Holding multiple blades in place while trying to insert the last several blades is difficult and unsafe as blades can slip and cause injury to the operators' fingers or hands.

A typical centrifugal abrasive throwing wheel of this kind is shown in U.S. Pat. No. 5,476,412. Among the objects of the present invention is an improved method of installing Blades to a single plate or to a set of interconnected wheel plates for a centrifugal blasting wheel.

Airless centrifugal throwing wheels of the type described consist of a single or double wheel plate having a number of blades extending radially from the wheel plate(s) in equally circumferentially spaced apart relation, with a means of securing the blades between the wheel plate(s). In operation, the bladed wheel is rotated at high speed about a central axis and abrasive particulate material is fed onto the inner portions of the blade whereby the material is displaced by centrifugal force outwardly over the surface of the blades and projected at high velocity from the ends of the blades.

Blades of this type typically wear out under the abrading effects of the particles that are thrown. These abrasive particles move along the blades and gradually wear out portions of the throwing wheel as well as the blades themselves. Further when the blades become worn, the blades need to be removed and the equipment needs to be reset. In some applications, blade replacement can take place as often as everyday.

SUMMARY OF THE INVENTION

The present invention relates to centrifugal blast wheel comprised of two interconnecting devices that comprise the two piece centering plate design for installing and retaining blades in wheel channel slots of the blasting wheel. The centering plate on a centrifugal airless shot blasting wheel is primarily used to keep the blades of the shotblast wheel in position after the blades are inserted into the wheel. Additionally, the centering plate can also be used as a spacer or positioning device for proper timing between the impeller and blades.

The disadvantages of prior art can be overcome by providing a method to insert blades into a wheel channel slot using a rotatable blade retainer in which the blades are secured in the wheel channel slot during the replacement process.

The centrifugal blast wheel apparatus is provided with a plurality of blade elements which connect to the wheel plate (s) usually through a wheel channel slot.

The first embodiment of the invention is a rotatable annular blade retainer with a radially extending blade guide slot in which the guide slot is wider than the width of the blade to allow the blade to readily slide through the guide slot opening.

The blade guide slot allows a single blade to be inserted into the wheel channel slot without other blades sliding out of the wheel channel slot(s) causing potential hand or finger injuries.

Once a blade is inserted, the blade retainer is then rotated until its blade guide slot is in position aligned with another wheel channel slot to allow the next blade to be inserted. The outer peripheral surface of, the blade retainer holds all other blades in position until the last blade is inserted and the retainer is rotated into a final end position which is not aligned with any wheel channel slot thus holding all blades in place.

The blade retainer cover is then placed over the rotatable blade retainer to lock the blade retainer in its final end position, and to protect it from the abrasive material used in the wheel blasting process. The cover is designed with an annular-shaped recess that receives the blade retainer and forms a corresponding impression that fits within the center opening of the blade retainer and blade retainer slot.

Wherein the centering plate is of two piece design, the first a rotatable blade retainer with a radially extending blade guide slot and the second a center cover plate.

Wherein the rotatable blade retainer has an outer diameter with a blade guide slot formed therein that is larger than the width of a single blade.

Wherein the rotatable blade retainer has an outer diameter that corresponds to the inner periphery of a wheel plate for a centrifugal blasting wheel.

Wherein the centering plate cover is designed with a similar outer diameter as the blade retainer to protect the blade retainer from abrasive material during operation.

Accordingly, in one embodiment, the present invention provides a centrifugal blasting wheel, comprising:

a rotatable annular wheel plate having a plurality of wheel channel slots extending radially from a central opening and equally spaced circumferentially around the wheel plate;

a blade releasably disposed in each channel slot;

a rotatable annular blade retainer disposed in said central opening, and having a radially extending blade guide slot formed therethrough, said guide slot having a width greater than said wheel channel slots; and a cover disposed over said blade retainer.

In another embodiment, the present invention provides a method of assembling blades to a wheel plate of a centrifugal blasting wheel, comprising the steps of:

(a) providing an annular wheel plate having a plurality of wheel channel slots extending radially from a central opening and equally spaced circumferentially around the wheel plate;

(b) inserting an annular blade retainer into said central opening, said blade retainer having a radially extending blade guide slot formed there through having a width greater than said wheel channel slots;

(c) inserting a blade through said blade guide slot into said wheel channel slot;

(d) rotating the blade retainer until said blade guide slot is aligned with a second wheel channel slot;

(e) inserting another blade through said blade guide slot into said second wheel channel slot;

(f) repeating steps (d) and (e) until a blade is installed in each wheel channel slot;

(g) rotating the blade retainer to a final end position which is not aligned with any wheel channel slot; and (h) placing a blade retainer cover over said blade retainer to lock the blade retainer in said final end position.

DETAILED DESCRIPTION OF THE PREFERRED EMBODIMENTS OF THE INVENTION

Figure 4:
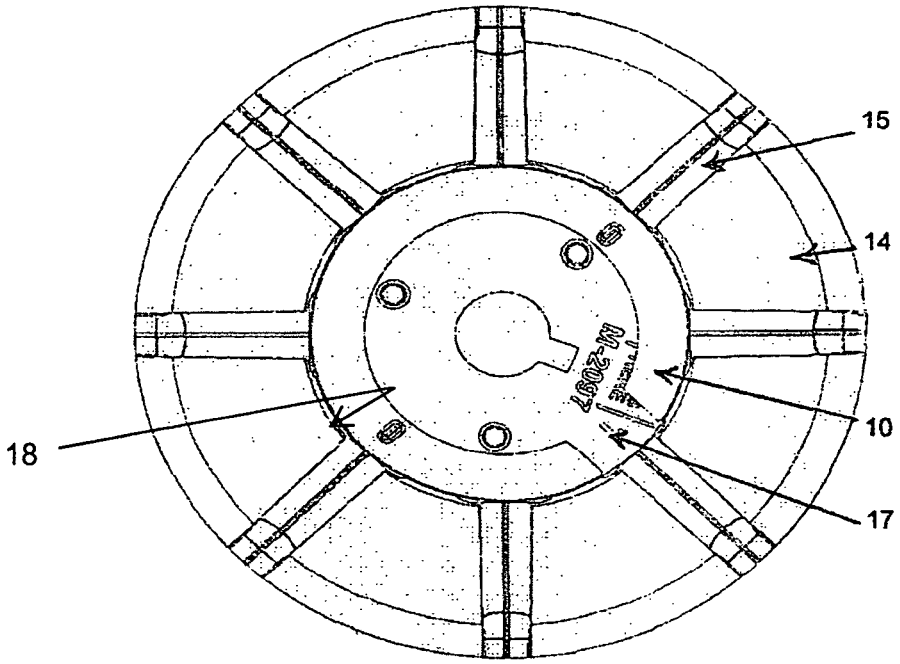
FIG. 4 is a the front view of the wheel plate and rotatable blade retainer in position with its blade guide slot aligned with and corresponding to a first wheel channel slot.

As illustrated in FIGS. 4-9, a typical wheel plate 14 for a centrifugal blasting wheel has from four to eight radial wheel channel slots 15 extending radially from a central opening defined by an inner circular surface 18 and equally spaced circumferentially around the wheel plate 14. As illustrated in the embodiment of FIG. 4, there are eight slots 15 each spaced 45° apart from one another, and each configured to accept a blade 12. Each blade 12 has a connecting member along one side of an edge of the blade 12 to interconnect the blade 12 to wheel plate 14, as is well known and conventional in this art.

Figure 1:
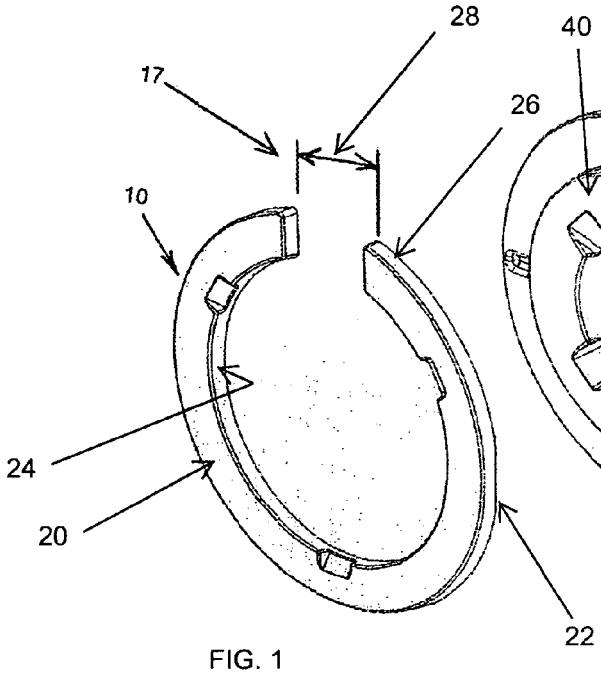
FIG. 1 is a perspective view of the rotatable blade retainer of the present invention.

Referring now to FIG. 1, a preferred embodiment for blade retainer 10 is illustrated. Blade retainer 10 comprises an annular shaped relatively flat ring member having opposite planar faces 20 and 22, an inner circumferential surface 24 defining an inner diameter, and an outer peripheral surface 6 defining an outer diameter. A blade guide slot 17 is formed through the ring member and extends from inner surface 24 to outer surface 26. Slot 17 has a width 28 which is slightly larger than the width of each wheel channel slot 15 formed in wheel plate 14 as well as the width of each blade 12 to be inserted into wheel plate 14.

Figure 2:
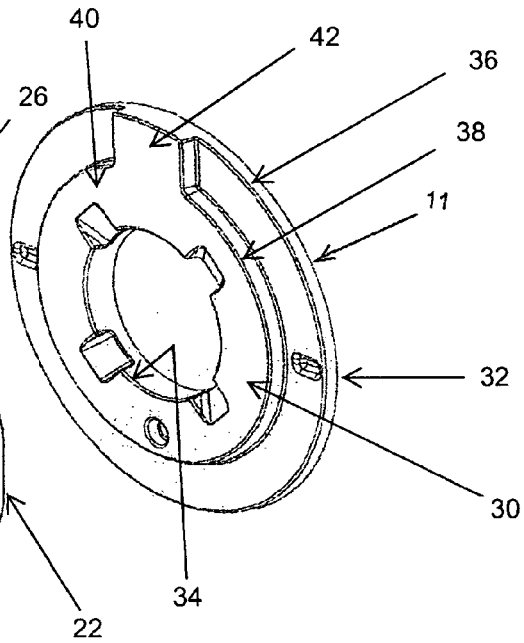
FIG. 2 is a perspective view of the center cover plate of the present invention.
Figure 3:
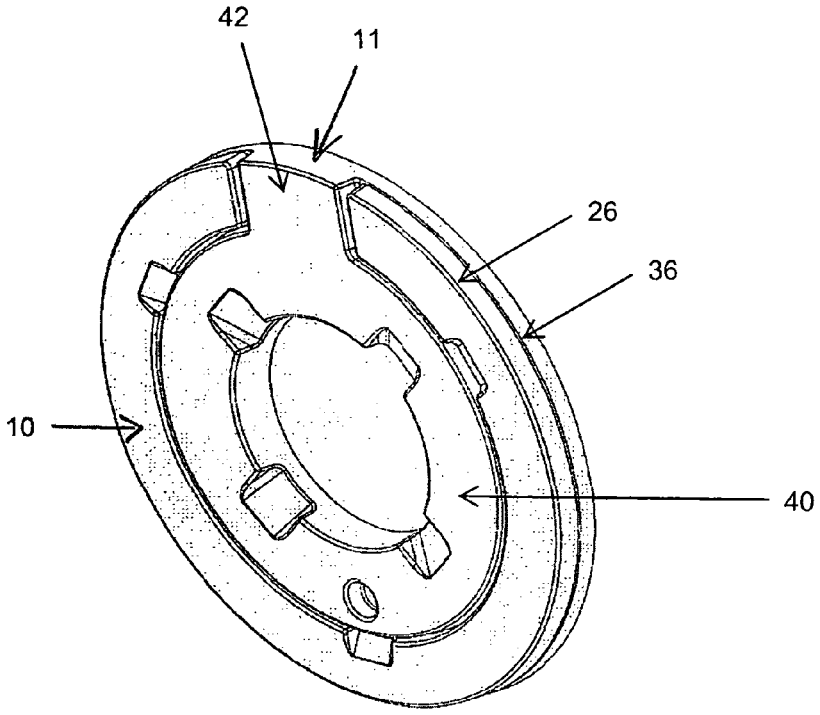
FIG. 3 is a perspective view of the rotatable blade retainer and the center plate engaged and assembled together.

FIG. 2 illustrates a preferred embodiment for center cover plate 11. Cover plate 11 comprises an annular shaped plate member having opposite radially extending planar faces 30 and 32, an inner circumferential surface 34 defining an inner diameter, and an outer peripheral surface 36 defining an outer diameter. An annular-shaped recess is formed in face 30 that corresponds dimensionally with blade retainer 10 so that retainer 10 may be received therein in a flush and mating relationship as illustrated in FIG. 3. Thus, when assembled, circumferential surface 38 defined by the recess in center cover plate 11 abuts against and mates with inner surface 24 of retainer 10, and outer surface 36 of cover plate 11 is flush with outer surface 26 of retainer 10, as best shown in FIG. 3. Also, the impression 40 including key 42 fits snuggly or nests within the center opening and blade retainer slot 17 of retainer 10.

Figure 5:
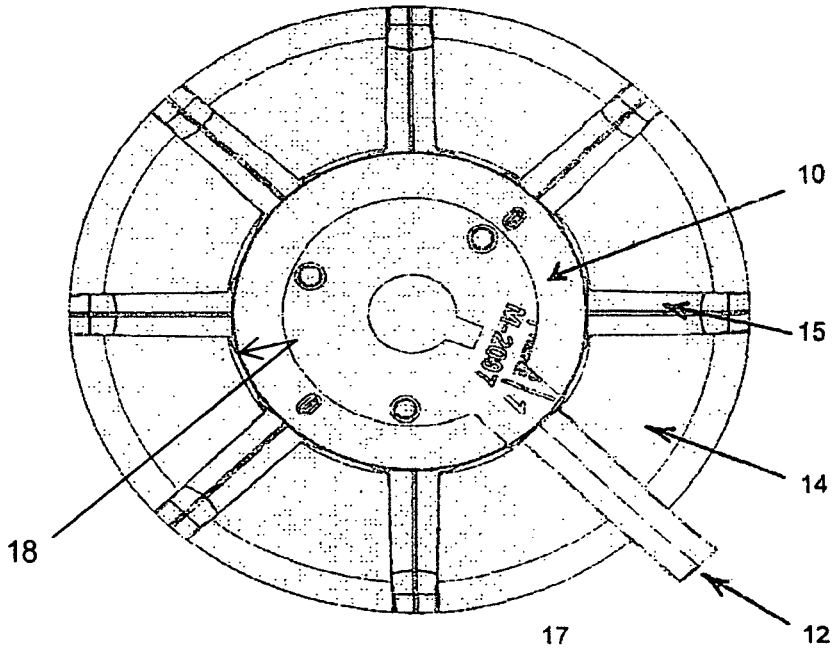
FIG. 5 is a the front view of the wheel plate with a blade inserted into the first wheel channel slot.
Figure 6:
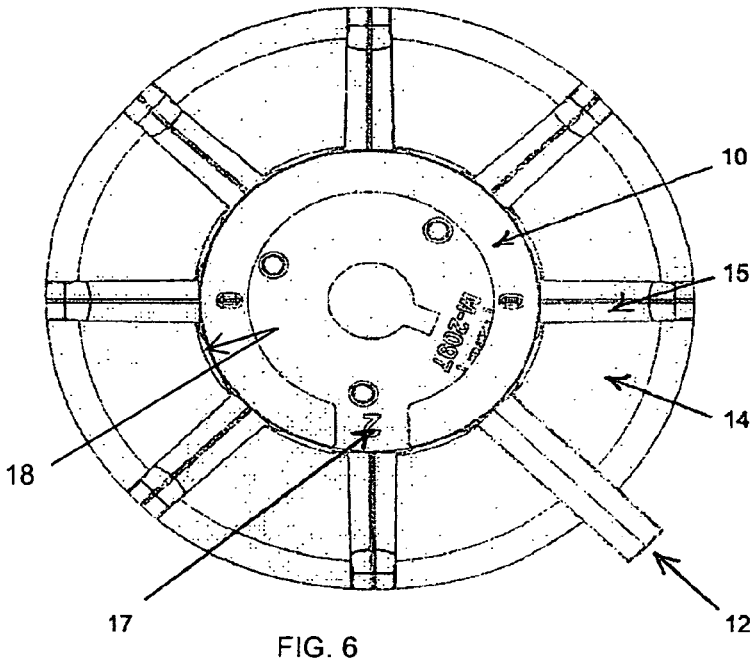
FIG. 6 is a front view of the wheel plate and rotatable blade retainer rotated and indexed to the next or second wheel channel slot.
Figure 7:
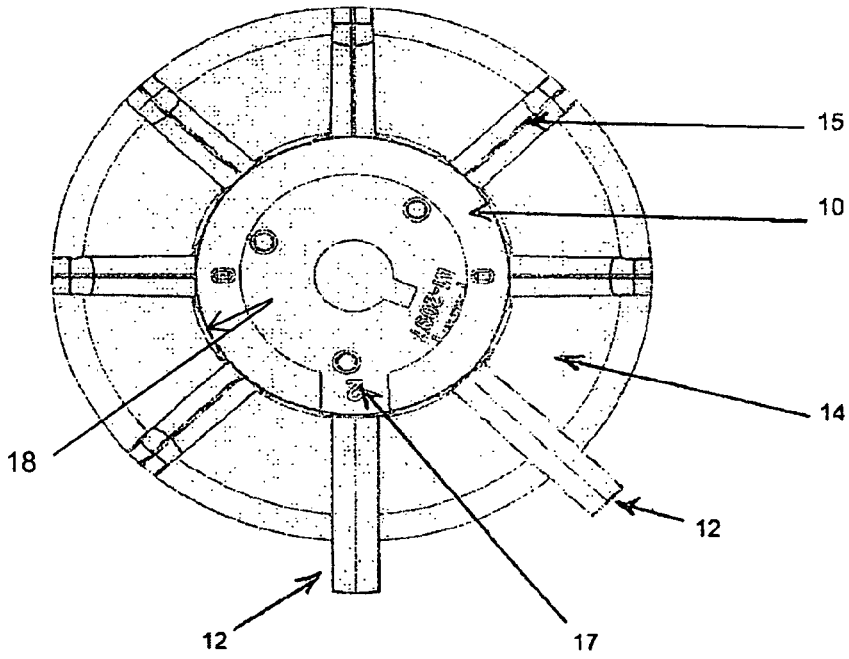
FIG. 7 is a front view of the wheel plate with the second blade inserted into the second wheel channel slot.
Figure 8:
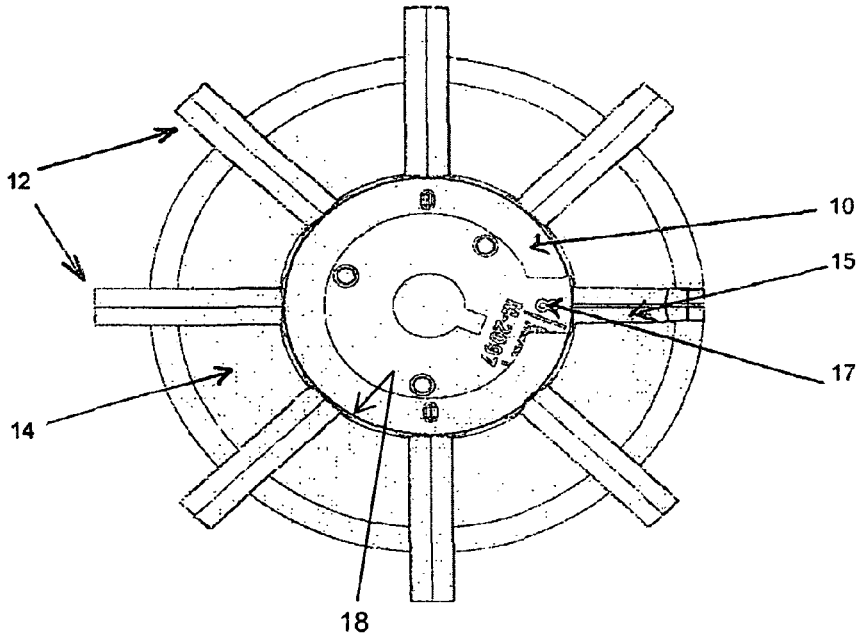
FIG. 8 is a front view of the wheel plate with the rotatable blade retainer indexed to an eighth and final wheel channel slot position.
Figure 9:
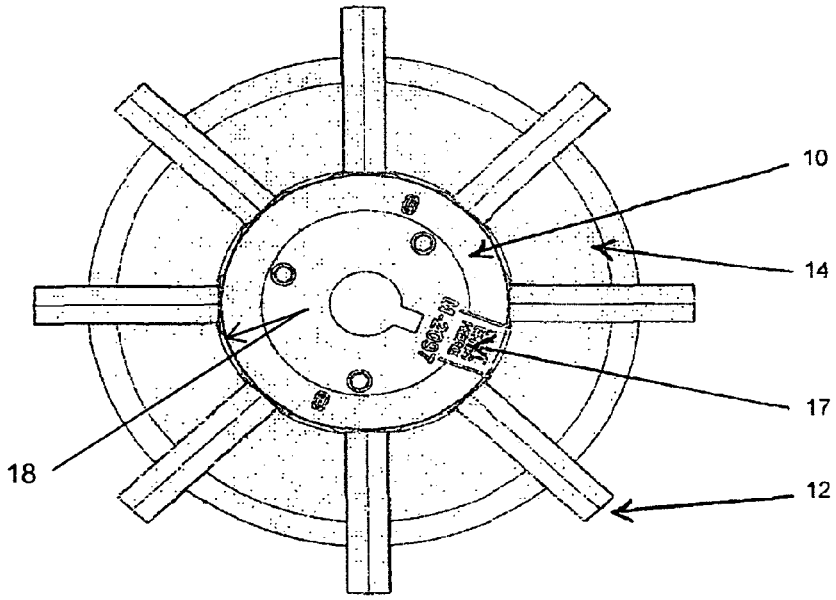
FIG. 9 is a front view of the wheel plate and rotatable blade retainer indexed to its final non-aligned position illustrating all blades inserted into their corresponding wheel channel slots.
Figure 10:
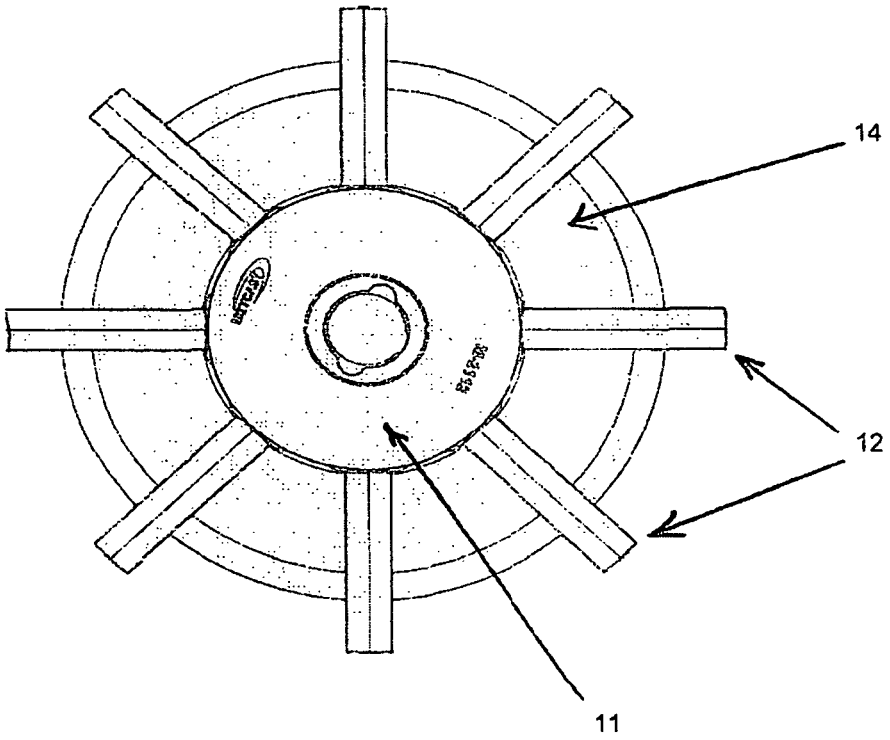
FIG. 10 is a front view of wheel plate and center cover plate engaged with the rotatable blade retainer.

In operation, a blade 12 is typically slidably inserted from the inner central portion of the wheel plate 14 into a wheel channel slot 15 as shown in FIG. 5 with the blade 12 fully seated into the wheel channel slot 15. Since the rotatable blade retainer 10 shown in FIG. 4 has a blade guide slot 17 which is wider than the width of the blade 12, the blade 12 may be easily inserted into the wheel channel slot 15 (see FIG. 5). After inserting the first blade, the rotatable blade retainer 10 is manually rotated from the first wheel channel slot 15 and aligned with the second wheel channel slot 15 as shown in FIG. 6. A second blade 12 is inserted through the blade retainer guide slot 17 into the wheel channel slot 15 and the rotating blade retainer 10 is again manually rotated and aligned with the next wheel channel slot 15. This indexing process continues with the rotatable blade retainer 10 until all blades 12 have been inserted into their corresponding wheel channel slots 15 as shown in FIG. 9 with the rotatable blade retainer 10 moved to an end stop or non-aligned position 17 (e.g. between the first and second wheel channel slots) in which all blades 12 are fully retained within the wheel channel slots 15. Once the rotatable blade retainer 10 is rotated to the end stop position 17, the center cover 11 is placed in position engaging and locking the rotatable blade retainer 10 in its end stop position as shown in FIGS. 3 and 10.

Although this disclosure has described and illustrated certain embodiments of the invention, it is to be understood that the invention is not restricted to these particular embodiments but encompass other embodiments that may include functional or mechanical equivalents to features that have been described and illustrated herein.

We claim:

1. A centrifugal blasting wheel comprising:

a rotatable annular wheel plate having an inner circular surface defining a central opening and having a plurality of wheel channel slots extending radially outwardly from said central opening and equally spaced circumferentially around the wheel plate, each of said slots having a radially inner end that opens to said central opening;

a blade releasably disposed in and radially slidable in each channel slot;

a rotatable annular blade retainer disposed in said central opening, said blade retainer rotatable in said central opening with respect to said annular wheel plate, and having an inner circumferential surface defining an inner diameter and a center opening coaxial with said central opening of said wheel plate and an outer peripheral surface defining an outer diameter substantially corresponding to the inner circular surface of said wheel plate, and having a radially extending blade guide slot formed therethrough and said blade guide slot extending from said inner circumferential surface to said outer peripheral surface, and said guide slot having a width greater than said wheel channel slots; and a cover disposed over said blade retainer, said cover having an inner planar face with an annular-shaped recess formed therein to define an axially projecting impression and key corresponding dimensionally with said center opening and blade guide slot, respectively, of said blade retainer, and said impression and key receivable in said center opening and blade guide slot to prevent rotation of said blade retainer and lock said blade retainer in place within said central opening.

2. The blasting wheel of claim 1 wherein said blade retainer is a relatively flat ring member having opposite planar surfaces one of which engages said wheel plate and the other of which engages said cover.

3. The blasting wheel of claim 1 wherein the recess of said cover receives said blade retainer therein in a flush and mating relationship.

4. The blasting wheel of claim 3 wherein the outer peripheral surface of said blade retainer is flush with an outer circumferential surface of said cover.

5. A method of assembling blades to a wheel plate of a centrifugal blasting wheel, comprising the steps of:

(a) providing an annular wheel plate having a plurality of wheel channel slots extending radially from a central opening and equally spaced circumferentially around the wheel plate;

(b) inserting an annular blade retainer into said central opening, said blade retainer having a radially extending blade guide slot formed therethrough having a width greater than said wheel channel slots;

(c) inserting a blade through said wheel guide slot into said wheel channel slot and sliding said blade radially outwardly in said wheel channel slot;

(d) rotating the blade retainer until said blade guide slot is aligned with a second wheel channel slot;

(e) inserting another blade through said blade guide slot into said second wheel channel slot;

(f) repeating steps (d) and € until a blade is installed in each wheel channel slot;

(g) roatating the blade retainer to a final end position which is not aligned with any wheel channel slot; and (h) placing a blade retainer cover over said blade retainer to lock the blade retainer in said final end position.

6. The method of claim 5 wherein eight blades are assembled to a wheel plate by rotating the blade retainer to eight different wheel channel slots.

* * * * *